US007600517B1

(12) United States Patent
Holzrichter

(10) Patent No.: US 7,600,517 B1
(45) Date of Patent: Oct. 13, 2009

(54) CIGAR OR CIGARETTE HOLDER AND SHIELD

(76) Inventor: Douglas J. Holzrichter, 1602 Bunker Ct., Geneva, IL (US) 60134

( * ) Notice: Subject to any disclaimer, the term of this patent is extended or adjusted under 35 U.S.C. 154(b) by 760 days.

(21) Appl. No.: 11/167,396

(22) Filed: Jun. 27, 2005

Related U.S. Application Data

(63) Continuation-in-part of application No. 10/939,208, filed on Sep. 13, 2004, now abandoned.

(51) Int. Cl.
*A24D 1/04* (2006.01)

(52) U.S. Cl. ..... 131/240.1

(58) Field of Classification Search ..... 131/350, 131/240.1
See application file for complete search history.

(56) References Cited

U.S. PATENT DOCUMENTS

| | | | | | |
|---|---|---|---|---|---|
| 1,781,566 | A | * | 11/1930 | Blesch | 131/182 |
| 1,807,617 | A | * | 6/1931 | Boenig et al. | 131/175 |
| 2,101,127 | A | * | 12/1937 | Bruins | 131/187 |
| 2,541,837 | A | * | 2/1951 | Schroff | 131/175 |
| 2,609,820 | A | * | 9/1952 | Vakilian | 131/175 |
| 2,620,804 | A | * | 12/1952 | McMahon | 131/175 |
| 2,690,754 | A | * | 10/1954 | Coleman | 131/178 |
| 2,711,176 | A | * | 6/1955 | Vakilian | 131/175 |
| 2,778,364 | A | * | 1/1957 | Nagle | 131/182 |
| 3,158,158 | A | * | 11/1964 | Womack | 131/191 |
| 3,313,308 | A | * | 4/1967 | Grasso | 131/187 |
| 3,405,719 | A | | 10/1968 | Lustbader | |
| 3,552,380 | A | * | 1/1971 | Heldt | 128/203.25 |
| 3,930,510 | A | * | 1/1976 | Johnston | 131/258 |
| 4,660,575 | A | * | 4/1987 | Andreason et al. | 131/256 |
| 4,907,603 | A | | 3/1990 | Chambers | |
| 5,345,953 | A | * | 9/1994 | Taylor | 131/256 |
| 5,499,634 | A | * | 3/1996 | Herrmann | 131/256 |
| 6,431,177 | B1 | * | 8/2002 | Sieggen et al. | 131/256 |
| 6,463,936 | B1 | * | 10/2002 | Hicks | 131/256 |
| 6,920,885 | B2 | * | 7/2005 | Braun | 131/256 |
| 2004/0173230 | A1 | * | 9/2004 | Snaidr et al. | 131/360 |
| 2006/0266374 | A1 | * | 11/2006 | Nyborg et al. | 131/258 |
| 2008/0053465 | A1 | * | 3/2008 | Tarora et al. | 131/187 |

* cited by examiner

*Primary Examiner*—Carlos Lopez
(74) *Attorney, Agent, or Firm*—Robert L. Marsh

(57) ABSTRACT

A device for protecting the lit end of a cigar or cigarette has a tubular body made of a nonflammable material with an inner diameter large enough to permit air to circulate around the lit end of the smoke. The tubular body is retained around the smoke by a second compressible tubular member fitted within the tubular body.

8 Claims, 2 Drawing Sheets

CIGAR OR CIGARETTE HOLDER AND SHIELD

This is a continuation in part of my application filed Sep. 13, 2004 and assigned Ser. No. 10/939,208, now abandoned.

The present invention relates to a device for protecting the lit end of a cigar or cigarette from being extinguished by wind.

BACKGROUND OF THE INVENTION

Sportsmen who are also smokers frequently desire to smoke while carrying on their sport. Cigar smoking golfers, for example, desire to walk across the fairway of a golf course without having their lit cigar extinguished by wind. When a cigar smoking golfer wishes to make a stroke, he must deposit his lit cigar in a location where the lit end thereof will not ignite flammable material and cause a fire, nor will it be extinguished, and the opposite end thereof will not contact dirt or other contaminants which will be subsequently brought to the smoker's mouth.

It would be desirable to sportsmen, therefore, to provide a device to aid in the smoking of a cigarette or cigar which would protect the lit end of his or her smoke from being extinguished by wind and which would protect both the lit end and the opposite end against contamination of the smoke when the smoke is momentarily placed aside.

SUMMARY OF THE INVENTION

Briefly, the present invention is embodied in a device for protecting the lit end of a cigar or cigarette having a given outer diameter. The device includes a tubular body having an inner opening with an inner diameter a little less than the diameter of the cigar or cigarette, hereinafter referred to as a "smoke," for which the device is intended to be used. Accordingly, when the cigar or cigarette is fitted into the inner opening of the device, the tubular end of the device will protect the lit end of the smoke from being extinguished by wind. Also, the outer diameter of the device should be sufficiently larger than the diameter of the smoke such that when the device, with a smoke fitted therein, is then placed on a surface, such as the surface of a green or a rock, both ends of the smoke will be elevated above the underlying surface thereby protecting both ends of the smoke from contamination.

The device has a tubular body with an axial inner opening. A second tubular member is fitted within the tubular body with the second tubular member having a length that is significantly shorter than the length of the tubular body. The second tubular member is made of compressible material and the inner opening thereof is a little less than the outer diameter of the smoke. Accordingly, when the cylindrical body of the smoke is fitted within the inner opening of the compressible tubular member, the inner wall of the second member will be compressed so as to apply a gentle force to the outer surface of the cylindrical wall of the smoke. The force supplied by the compressible member will thereby retain the smoke from inadvertent axial movement within the second tubular member.

The device also includes means, such as a flange, for retaining the second tubular member against axial movement within the tubular body. In the preferred embodiment, the tubular body has an overall length which is longer than the overall length of the second tubular member such that a portion of the tubular body extends beyond the second tubular member to provide a hollow tube that will surround the lit end of the smoke. Air is therefore permitted to circulate around the lit end of the smoke such that combustion will continue, but a portion of the tubular body will shield the lit end from wind so as to prevent the lit end from being extinguished.

Preferably, the device also includes at least one inwardly directed flange within the tubular body having an inner diameter that is a little larger than the outer diameter of the cylindrical wall of the smoke. The flange has a central opening that is a little larger than the diameter of the smoke so as to allow the barrel of the smoke to extend therethrough, and serves as a barrier to prevent the second tubular member from sliding toward the outer end of the tubular body.

The central opening of the flange defines a narrowed cylinder. The flange is positioned a sufficient distance from the distal of the tubular body to provide a protected area in which air can circulate around the lit end of the smoke. However, as the lit end of the smoke burns and grows shorter as the tobacco of which it is made is consumed, the lit end will gradually be drawn within the inner opening of the flange. The overall length of the flange is such that after the lit end has burned through the length thereof, the confines of the space within the flange will suffocate the lit end of the smoke.

BRIEF DESCRIPTION OF THE DRAWINGS

A better understanding of the present invention will be had after a reading of the following detailed description taken in conjunction with the drawings wherein.

DETAILED DESCRIPTION OF A PREFERRED EMBODIMENT

Figure 1:
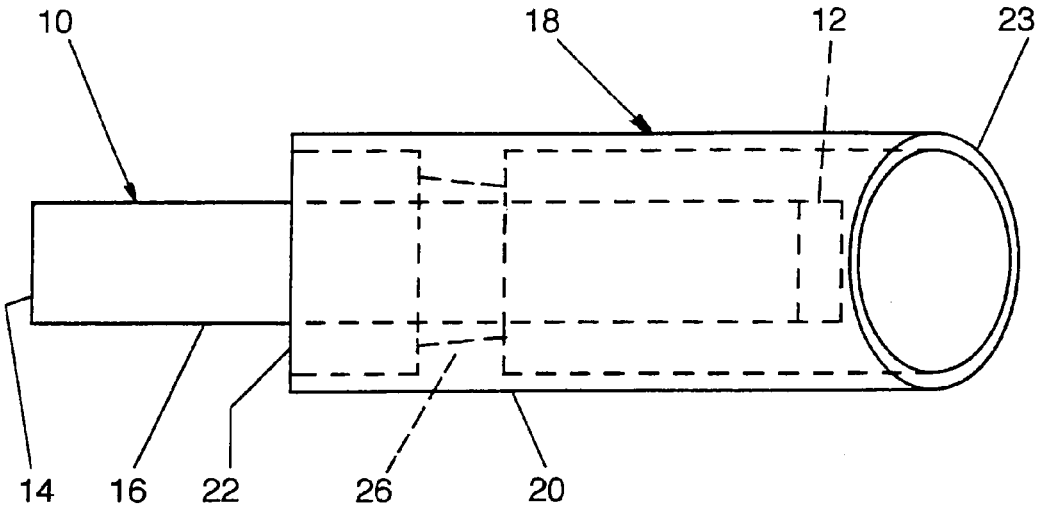
FIG. 1 is a side view of the device of the present invention fitted around a cigar with the inner portions of the device shown in broken lines.
Figure 2:
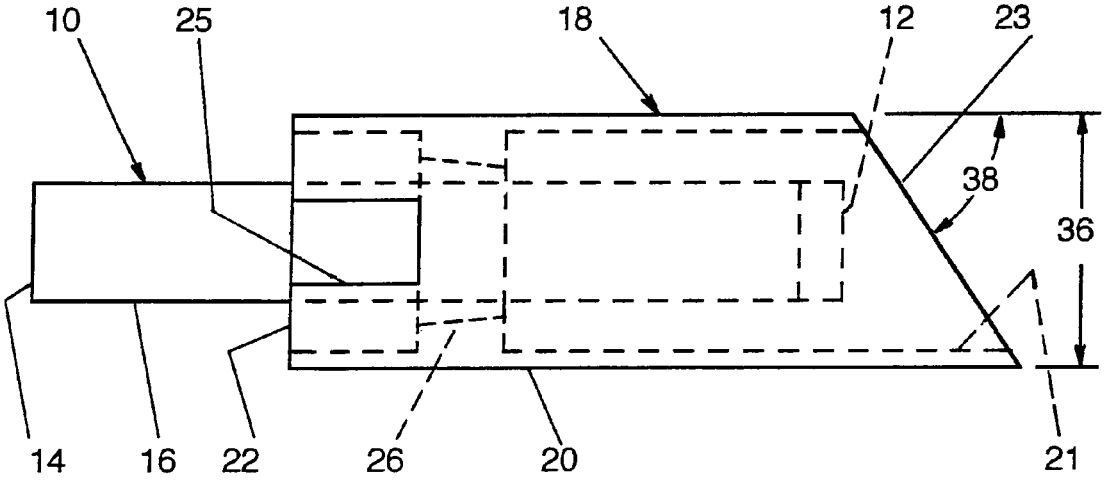
FIG. 2 is a second side view of the device shown in FIG. 1 with the device axially rotated through ninety degrees and the inner parts again shown in broken lines.
Figure 3:
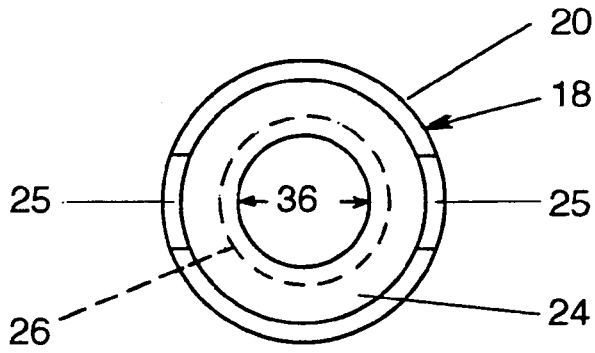
FIG. 3 is one end view of the device shown in FIG. 1.

Referring to FIGS. 1 through 4, to protect a smoke 10, such as a cigarette or a cigar, having a lit end 12, a mouth end 14 and a cylindrical barrel 16 extending from the mouth end 14 to the lit end 12, the barrel 16 is fitted into a device 18 in accordance with the present invention. The device 18 has a tubular body 20 made of a suitable, generally rigid non-combustible material such as a metal or a thermoset plastic. The tubular body 20 has a cylindrical inner surface 21, an inner end 22, and an outer end 23, and fitted within the cylindrical surface 21 is a second tubular member 24 made of a compressible material such as a foam or rubber. The second tubular member 24 has an outer diameter that is at least as large as the inner diameter of the tubular body 20 and is retained against moving forwardly within the body 20 by a flange 26. The inner diameter of the second tubular member 24 is a little less than the outer diameter of the barrel 16 of the smoke 10 such that when the barrel of the smoke 10 is fitted into the opening of the second tubular member 24, the walls thereof will be compressed and a force will be applied by the compressed walls against the barrel 16 of the smoke 10 thereby retaining the smoke 10 against inadvertent axial movement within the tubular body 20. The tubular body 20 has a pair of opposing parallel slots 25 extending into the wall thereof from the inner end 22 to enable a user to grasp the outer wall of the second tubular member 24 and remove it from within the tubular body 20 for cleaning after each smoke.

The length of the second tubular member 24 is approximately one fourth the length of the tubular body 20 and therefore it occupies only a small portion of the length of the body 20. Preferably, one end of the second tubular member is positioned co-planar with the inner end 22 of the body 20 as shown.

Figure 4:
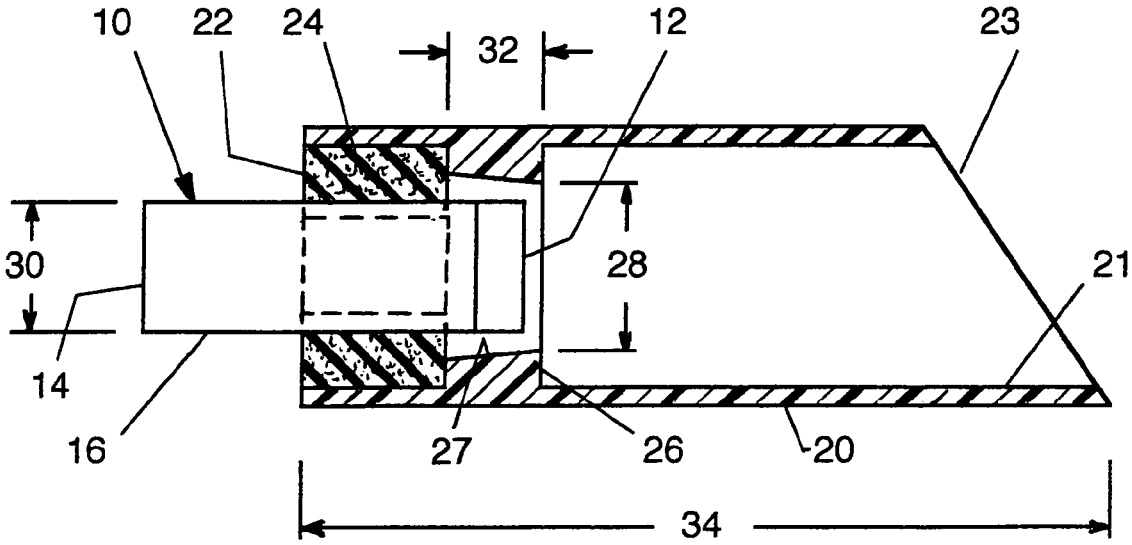
FIG. 4 is a longitudinal cross-sectional view of the device shown in FIG. 1 showing the cigar therein after it has been substantially consumed and ready to be extinguished by the device.

In the preferred embodiment, the tubular flange 26 has an inner end that abuts the outer end of the second tubular member 24. The tubular flange 26 has an inner surface 27 with a minimum diameter 28 that is a little larger than the outer diameter 30 of the barrel 16 of the smoke 10. The overall length 32 of the flange 26 is sufficient to trap the gases of combustion after the lit end of the smoke 10 has burned the tobacco within the confines thereof as shown in FIG. 4. The trapped gases will smother the burning tobacco and cause the smoke to go out. In the preferred embodiment, the inner surface 27 of the tubular flange 26 is tapered with the narrow end directed outwardly so as to restrict the amount of air reaching the stub of a smoke 10, and the inner end is somewhat enlarged to allow easy insertion of a new smoke 10.

Where the device is used to protect the burning end of a cigar of the type having an outer diameter of approximately one-half inch, the inner diameter 36 of the second tubular member 24 will be a little less than one-half inch. The minimum inner diameter 28 of the flange 26 will be about seven-eighth inch and the overall length 32 of the flange will be about one-half inch. Where the device 18 is intended to be used with a cigar with a three-fourths inch diameter, the overall length 34 of the body 20 should be about four and one-fourth inches and the outer diameter 36 should be about one and one-half inches. With a tubular body 20 having such dimensions there will remain sufficient space within the inner opening of the body 20 for air to circulate around the lit end 12 of the smoke 10 and thereby continue the combustion and retain the end 12 in the lit condition.

The device 18 has been depicted as having the outer end 23 thereof oriented at an angle 38 of approximately 35 degrees. The angle of the outer end 23 increases the esthetic qualities of the device 18.

When used to protect the lit end of a smoke 10, such as a cigar, the cigar is first lit and thereafter the lit end is pushed through the central opening of the second tubular member 24 adjacent the inner end 22 of the tubular body 20. The device 18 is moved along the barrel 16 of the cigar 10 until the lit end thereof approaches the outer end 23 of the device 18. It is desirable that the lit end 12 of the cigar 10 be spaced a short distance within the outer end 23 of the device, as shown in broken lines in FIGS. 1 and 2, such that the lit end 12 thereof will be protected by the walls of the tubular body 20. As the cigar 10 is smoked, the lit end will retract towards the flange 26. To prevent the lit end from being smothered by the flange 26, the barrel of the cigar is pushed further forwardly through the second tubular member 24.

Normally, a smoker will remove his smoke from the device 18 before the flame is extinguished as it burns into the restricted area of the flange 26. For those occasions where the smoker has placed his smoke 10 and the device 18 down for a long period of time, however, the confines of the flange 26 will extinguish the smoke 10 before a fire hazard can occur. Once the smoke is extinguished, the butt is removed from the second tubular member 24 and the device can be stored or a new smoke inserted into the rearward end of the second tubular member 24 and the device reused.

It should be appreciated that the parts of the device 18 should all be made of materials that are nonflammable, and will not melt or degrade with the presence of the lit end of a smoke. Preferably, the body 20 and flange 26 are made of a metal or a thermoset plastic.

While the present invention has been described with respect to a single embodiment, it will be appreciated that many modifications and variations may be made without departing from the true spirit and scope of the invention. It is therefore the intent of the appended claims to cover all such modifications and variations which fall within the true spirit and scope of the invention.

What is claimed:

1. A device for protecting the lit end of a smoke having an outer diameter, said device comprising a tubular body having an axial opening, a first open end and a second open end, an annular flange within said tubular body, a second tubular member fitted within said tubular body between said first open end and said annular flange wherein said second tubular member is retained by said annular flange against axial movement toward said second open end, said second tubular member having a central opening with an inner diameter that is less than said outer diameter wherein said smoke is retained against axial movement while fitted within said central opening, said tubular body having a slot therein, and said slot having two slot edges that extend to said first open end wherein said second tubular member is reachable through said slot by a user for removing and cleaning said second tubular member.

2. The device of claim 1 wherein said second tubular member is made of a compressible material.

3. The device of claim 1 wherein said second tubular member is made of one of rubber and foam.

4. The device of claim 1 wherein said annular flange in the said tubular body has an inner diameter larger than said outer diameter and having a length sufficiently long such that as said lit end of said smoke grows shorter and is retracted into said inner diameter of said flange said lit end is suffocated.

5. The device of claim 1 wherein said second open end defines an angle of about thirty-five degrees from a plane parallel to said longitudinal axis.

6. The device of claim 1 wherein said second open end defines a plane that is at an angle that is generally midway between a plane perpendicular to a longitudinal axis of said tubular body and a plane parallel to said longitudinal axis.

7. The device of claim 1 wherein said tubular body has a second slot therein diametrically opposite said slot, and said second slot has parallel side edges extending to said first open end.

8. The device of claim 1 wherein said second tubular member extends continuously from said annular flange to said first open end.

* * * * *